US006035750A

United States Patent [19]

Hansen

[11] Patent Number: 6,035,750

[45] Date of Patent: Mar. 14, 2000

[54] HOLE CUTTER WITH VACUUM SLUG REMOVAL

[76] Inventor: Peter T. Hansen, 1460 Harrison Ave., Salt Lake City, Utah 84105

[21] Appl. No.: 08/721,504

[22] Filed: Sep. 26, 1996

Related U.S. Application Data

[60] Provisional application No. 60/005,476, Oct. 16, 1995.

[51] Int. Cl.[7] ..... B26D 7/18; B26F 1/00

[52] U.S. Cl. ..... 83/24; 30/124; 30/316; 30/358; 83/100; 83/684; 83/698.91

[58] Field of Search ..... 83/100, 24, 684, 83/698.91; 30/316, 358, 124, 125, 130

[56] References Cited

U.S. PATENT DOCUMENTS

| | | | |
|---|---|---|---|
| 1,109,446 | 9/1914 | Melgerg | 30/124 |
| 1,451,610 | 4/1923 | Gestas | 83/100 |
| 2,083,476 | 6/1937 | Rossin | 30/358 |
| 2,087,186 | 7/1937 | Freeman, Jr. | 30/358 |
| 2,266,393 | 12/1941 | Hoffman | 30/358 |
| 2,424,474 | 7/1947 | MacGregor | 30/358 |
| 2,463,455 | 3/1949 | Dann | 30/358 |
| 2,568,284 | 9/1951 | Harrison | 83/684 |
| 3,949,471 | 4/1976 | Cawley | 83/100 |
| 4,010,543 | 3/1977 | Nusbaum . | |
| 4,417,679 | 11/1983 | Shields | 83/100 |
| 5,255,585 | 10/1993 | Gordon | 83/100 |

FOREIGN PATENT DOCUMENTS

| | | | |
|---|---|---|---|
| 1075996 | 4/1954 | France | 30/316 |
| 24612 | of 1898 | United Kingdom | 30/358 |

*Primary Examiner*—Rinaldi I. Rada
*Assistant Examiner*—Sean Pryor
*Attorney, Agent, or Firm*—Trask, Britt & Rossa

[57] ABSTRACT

A hole cutter adapted for cutting holes through the sidewalls of medical catheters is fashioned from a hollow tube having a distal cutting end, a proximal ejection end and a lumen of smaller diameter near the cutting end. Slugs formed at the cutting end are extracted by suction applied to the ejection end, and are captured by a filter.

15 Claims, 1 Drawing Sheet

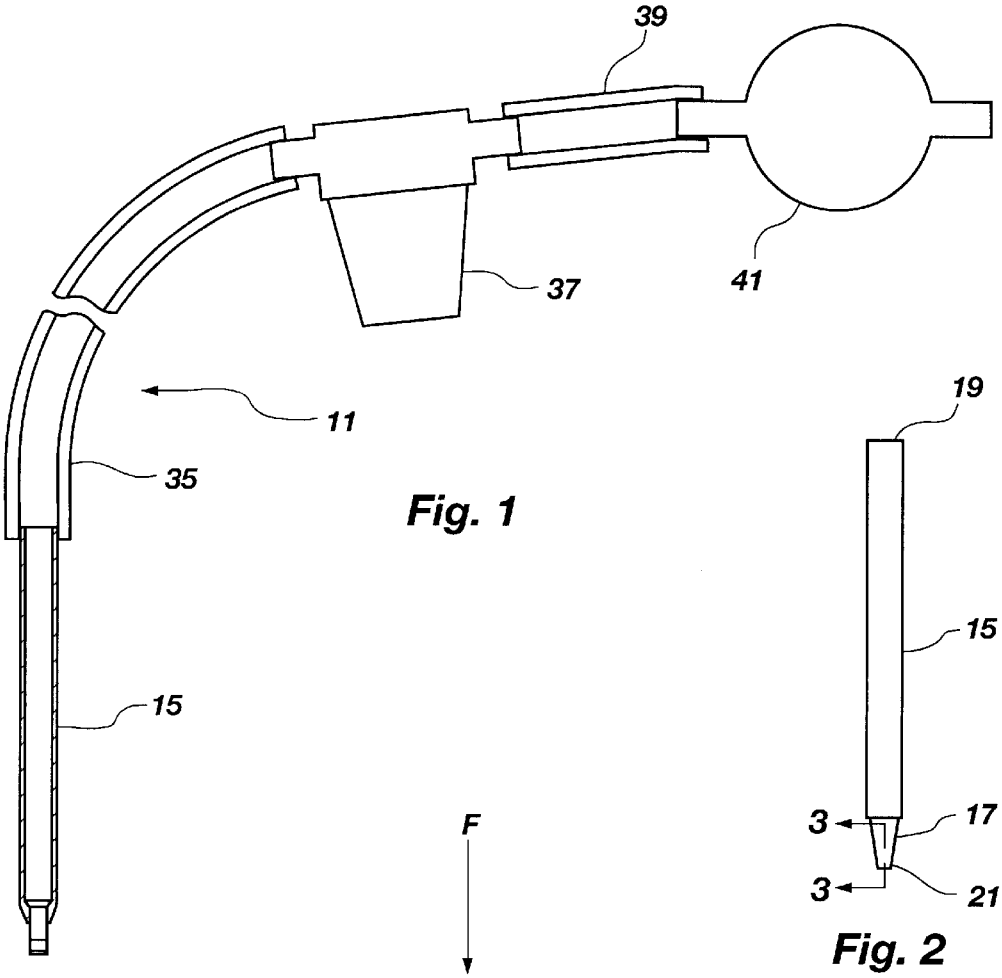
Fig. 1
Fig. 2
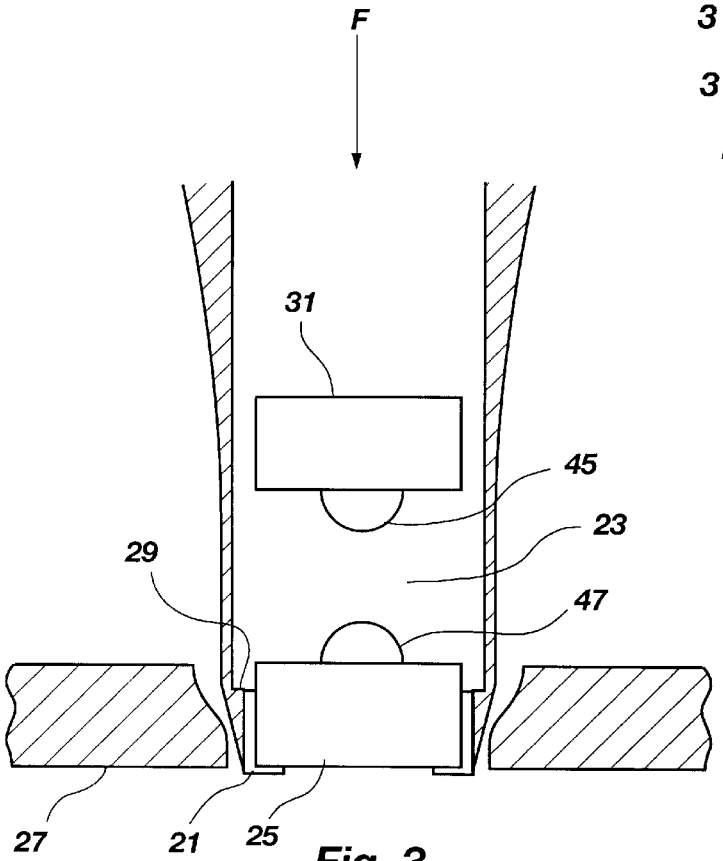
Fig. 3

HOLE CUTTER WITH VACUUM SLUG REMOVAL

BACKGROUND OF THE INVENTION

1. Related Applications

This application claims the benefit under 35 USC 119(e) of the filing date of Provisional application Ser. No. 60/005,476, filed Oct. 16, 1995 for HOLE CUTTER WITH VACUUM REMOVAL.

2. Field

This invention relates to hole cutting apparatus. It is specifically directed to hollow punches and hole cutters. It provides an improved means for ejecting and capturing discard slugs produced by such punches and cutters.

3. State of the Art

Many types of hole cutters and punches of specialized design are known. Special purpose cutters are often required for specific applications or for use with particular materials. There are various known techniques available for forming a hole in a material. A suitable hole may often be provided by punching through a material with a solid or hollow punch. In some applications, an acceptable hole is formed by applying pressure, and frequently impulse force, to a solid punch to knock out a "slug," leaving a hole in the material. Other applications utilize a hollow punch to remove a core or slug from a piece of material. The material to be cut may be placed between the hollow punch and a supporting substrate. The punch, which is typically in the form of a hollow tube with a distal cutting edge, is pressed down upon the material, which shears along the cutting edge. A slug of material is removed with the punch, leaving a hole through the material. U.S. Pat. No. 4,010,543 to Nusbaum discloses a typical special purpose hollow tube device of this type.

Hollow punches are often round, and can thus be rotated to cut a hole. They are then typically referred to as "tube cutters." Rotation of the cutter during hole formation reduces burrs around the edge of the resulting hole. Moreover, suitable holes can be formed with rotating cutters without the use of a supporting substrate.

Proper selection of a cutter or punch is necessarily dependent upon the nature and dimensions of the material to be cut. For example, if the material is thin and stiff, such as paper or cardboard, a hole puncher can be utilized. On the other hand, removing the core of a fruit, such as an apple, is better accomplished through use of a hole cutter.

Punch shapes vary according to specific requirements. Round shapes are most common, although oblong, elliptical, and square punches are also common. Rotating cutters are ordinarily utilized for forming substantially round holes.

Medical catheters are an example of a hole cutting operation in which proper retrieval or disposal of discard (slug) material is important. Holes are often cut through plastic catheter tubing transverse the tubing's lumen. Catheters are routinely inserted into the circulatory or respiratory systems of a patient. It is thus important that the catheter not be a source of debris. Catheters are variously used to deliver and extract fluid from the blood stream, enter the peritoneal cavity for dialysis, sense pressure inside blood vessels near the heart, and monitor contraction pressure during child birth. Slugs that are not removed from the catheter may become lodged in the body. Present practice involved in the cutting of holes in medical catheters relies upon the slug's remaining inside the hollow cutter tube through frictional engagement with the interior surface of the cutter. The slug is later pushed out of the distal (cutting) end of the cutting tube with a rod, which is inserted from the proximal (or opposite) end of the cutting tube. This slug-ejection method tends to result in a scattering of slugs in the cutting area. Occasionally, ejected slugs cling to the outside of the catheter tubing. Furthermore, the added motion required for the ejection step increases the time needed to make a hole, and increases the complexity of the machinery required for hole cutting. A slug may also remain in the lumen of the catheter because the slug is not frictionally engaged by the interior surface of the cutter.

SUMMARY

The present invention provides a hole cutting apparatus which avoids the shortcomings of previous devices with respect to slug disposal. The invention provides a hole cutting apparatus capable of forming holes of circular or various non-circular shapes in soft materials. A notable benefit offered by the present invention is an improved system for extracting slugs from a cutter.

The hole cutting apparatus of the present invention finds particular use in cutting plastic tubes. The present apparatus provides a slug ejection system which removes the slug through the center of the hollow hole cutter for effective transport to a filter. The apparatus of this invention may be embodied as either a punch or a rotating cutter. In any case, it may be particularly adapted for cutting holes through the sidewalls of medical catheters.

Generally, this invention provides a hole cutting apparatus comprising a hollow tube having a distal (cutting) end terminating in a cutting edge, a proximal (ejection) end a lumen, extending between the distal and proximal ends, the lumen being of smaller diameter near the distal end than at the proximal end, and ejection means constructed and arranged for urging a slug of material lodged in the distal end towards the proximal end.

The ejection means presently preferred in practice is suction applied to the proximal end of the tube. Any mechanism effective to extract discard slugs from the proximal end of the tube could be substituted. An important characteristic of this invention is the extraction, or ejection, of discard slugs away from the cutting end of the cutter. Ideally, a moving air stream carries the slugs out of the cutting tube and transports them to a capturing or collection device, such as a filter.

Preferably, the lumen includes a first portion, extending from the cutting edge to a shoulder, and a second portion, extending from the shoulder to the proximal end. The first portion will have a cross sectional configuration substantially congruent with a preselected cross sectional shape of a discard slug. The second portion should have a cross sectional configuration which permits free travel of a slug from the shoulder to the proximal end. Assuming that the cutter is embodied as a hollow punch of circular cross sectional configuration, both the first and second portions of the lumen will typically have circular cross sectional configurations, with the second portion having a somewhat larger diameter. Usually, the two cross sections are substantially concentric, but other arrangements are operable.

To maintain unobstructed flow of ejection fluid (typically air) through the cutter, at least one aperture may be provided in the side wall of the tube, communicating with the lumen near the distal end of the tube. In the preferred embodiments, at least one such aperture communicates with the lumen at the shoulder. The cross sectional area of the aperture(s) are typically about ⅓ the cross sectional area of the lumen of the catheter to assure adequate fluid flow through the lumen to extract the slug. The apertures are ideally located about one to about three slug thicknesses from the distal end of the cutter. The width of an aperture should be small enough, typically less that about ⅓ of a slug diameter, to avoid lodging of a slug edge in an aperture.

The invention thus provides an improvement in the method of cutting a hole in material by forcing the distal end of a hollow cutting tube through the material to remove a discard slug, removing the tube with the slug from the material, and ejecting the slug from the tube. This improvement broadly comprises providing the cutting tube in the form of a hollow tube having a lumen, extending between the distal and proximal ends of the tube, the lumen being of smaller diameter near the distal end than at the proximal end, and ejecting slugs of material from the proximal end of the tube. The lumen preferably has a distal portion of smaller cross sectional area, defined by a shoulder positioned a distance from the cutting edge approximately equal to the thickness of one or two of the discard slugs. "Approximately equal," in this context is intended to include distances substantially smaller to slightly larger than (sometimes, up to twice) the slug thickness. The function of this reduced diameter portion is to provide a frictional interface between the slug and the lumen sufficient to hold the slug in position until it is forced into the enlarged portion during subsequent cutting operations.

BRIEF DESCRIPTION OF THE DRAWINGS

In the drawing, which illustrates what is currently regarded as the best mode for carrying out the invention.

FIG. 1 is a view in side elevation, partially in section, of a cutting apparatus of this invention;

FIG. 2 is a view in elevation of a cutter tube element of the apparatus of FIG. 1; and FIG. 3 is an enlarged view of a portion of FIG. 1 designated by the line 3—3, shown in working position with respect to a work piece.

DETAILED DESCRIPTION OF THE ILLUSTRATED EMBODIMENT

A hole cutting device, generally 11 (FIG. 1), includes a hollow, shaft-like tube 15 having a bottom (distal) end 17 and top (proximal) end 19 (FIG. 2). The distal end 17 terminates in a cutting edge 21 of significantly reduced wall thickness. The edge 21 may be formed by chamfering either or both the inside and outside surfaces of the tube 15.

As best shown by FIG. 3, the diameter of the lumen 23 of the hollow tube 15 at its cutting edge 21 is selected as appropriate to cut a slug 25 of specified size from a work piece 27. This dimension is maintained for a very short portion of the lumen's length, as illustrated, approximately the thickness of a single slug 25. As shown, the lumen 23 assumes a significantly larger diameter at a shoulder 29. The slug 31 is approximately identical in shape and dimension to the slug 25, but while the slug 27 is held within the lumen 23 by frictional resistance, the slug 31 is relieved from frictional contact sufficiently to permit it's free travel towards the proximal end 19.

For purposes of illustration, the tube 15 and its lumen 23 are presumed to be circular in cross section so that the slugs 25, 31 will inevitably be in the shape of circular cylinders. It is, of course, within contemplation that the tube 15 and lumen 23 be shaped and dimensioned to cut slugs of other cross-sectional configuration.

To facilitate slug ejection and capture, suction may be applied to the lumen 23 at the proximal end 19 of the tube 15. As shown by FIG. 1, a flexible hose 35 connects the hollow tube 15 through a filter 37 and a second length of hose 39 to a vacuum pump 41. Flow is maintained through the lumen 23, even with a slug 25 in residence at the distal end 17 of the tube, by virtue of radial apertures 45, 47. It should be noted that the aperture 47 intersects the lumen 23 at the shoulder 29, where the diameter of the lumen 23 reduces towards the cutting edge 21.

Operation of the apparatus 11 can best be understood with reference to FIG. 3. The tube 15 is first pressed into the material 27 to be cut and is pushed with downward force as shown by the arrow F. Chamfering of the cutting edge 21 facilitates clean cutting of the material 27. The discard from the cutting step, slug 25, will remain in the position shown, at the distal end of the tube 15, because of the friction interface between the slug 25 and the lumen 23. Entry of the slug will inevitably dislodge a previously cut slug 31 up and into the region of the lumen 23, between the shoulder 29 and the proximal end 17, of increased diameter. The previously cut slug 31 is thus no longer held by friction. It is transported up the lumen by a stream of air entering through the vent holes 45, 47. The slug 31 is carried through flexible tube 35 to the filter 37, where it is captured. As the tube 15 is lifted from the material 27, the most recently produced slug 25 will remain in the lumen 23, as shown, until a subsequent hole is cut.

In a typical embodiment of the present invention, the tube 15 may be made of hardened stainless steel. The outer diameter of a tube cutter useful for forming radial holes in medical catheters can typically vary from approximately 1/100 of an inch to approximately ⅜ of an inch. A typical slug diameter is approximately 1/16 inch, varying between about 1/50 to about 5/16 of an inch. Adequate relief for most purposes is provided by enlarging the lumen at 29 by as little as 0.001 inch. A practical tube 15 height is approximately an inch, a useful range being about ⅞ to about 1½ inches, although this dimension is not critical to operability of the invention. These typical dimensions are by way of example only, it being understood that the invention can be applied in environments requiring equipment of much larger or smaller scale.

While this disclosure has focused upon a punch mode of operation, the invention is readily adaptable to rotating cutter modes of operation. A system constructed substantially as illustrated by FIG. 3 may incorporate a mechanism to impart several degrees of rotation to assist cutting. Alternatively, a suitable rotating coupling mechanism (not shown) may be incorporated; e.g., at the junction between the tube 15 and the hose 35. The tube 15 may then be driven as a rotating cutter, or even spun in the manner of a hollow drill. In any case, the slug ejection and capturing feature of this invention may be beneficially incorporated.

Reference in this disclosure to specific details of the illustrated or preferred embodiments is not intended to restrict the scope of the appended claims, which themselves are intended to define the invention in terms of appropriate scope.

What is claimed is:

1. A hole cutting apparatus, comprising:

a hollow tube having:

a distal end terminating in a cutting edge;

a proximal end;

a lumen, extending between said distal and proximal ends, said lumen being of smaller diameter near said distal end than at said proximal end; and ejection means constructed and arranged for urging a slug of material cut by said hollow tube from a piece of said material and lodged in said distal end towards said proximal end.

2. Apparatus according to claim 1, wherein said lumen includes:

a first portion, extending from said cutting edge to a shoulder, said first portion having a cross sectional configuration substantially congruent with a preselected cross sectional shape of a discard slug; and a second portion, extending from said shoulder to said proximal end, said second portion having a cross sectional configuration which permits free travel of said slug from said shoulder to said proximal end.

3. Apparatus according to claim 1, wherein said ejection means comprises suction applied to said proximal end.

4. Apparatus according to claim 3, further including at least one aperture in a side wall of said tube communicating with said lumen near said distal end.

5. Apparatus according to claim 4, wherein said lumen includes:

a first portion, extending from said cutting edge to a shoulder, said first portion having a cross sectional configuration substantially congruent with a preselected cross sectional shape of a discard slug; and a second portion, extending from said shoulder to said proximal end, said second portion having a cross sectional configuration which permits free travel of said slug from said shoulder to said proximal end.

6. Apparatus according to claim 5, wherein at least one said aperture communicates with said lumen at said shoulder.

7. Apparatus according to claim 3, further including a filter constructed and arranged to receive and capture slugs drawn out of said tube by said suction.

8. Apparatus according to claim 7, further including at least one aperture in a side wall of said tube communicating with said lumen near said distal end.

9. Apparatus according to claim 8, wherein said lumen includes:

a first portion, extending from said cutting edge to a shoulder, said first portion having a cross sectional configuration substantially congruent with a preselected cross sectional shape of a discard slug; and a second portion, extending from said shoulder to said proximal end, said second portion having a cross sectional configuration which permits free travel of said slug from said shoulder to said proximal end.

10. Apparatus according to claim 9, wherein at least one said aperture communicates with said lumen at said shoulder.

11. Apparatus according to claim 9, wherein the cross sectional configuration of said first and second portions of said lumen are approximately circular.

12. Apparatus according to claim 11, wherein the cross sectional configuration of said first and second portions of said lumen are approximately concentric.

13. In the method of cutting a hole in material having a thickness by forcing the distal end of a hollow cutting tube having distal and proximal ends through said material to remove a discard slug having said thickness of said material, removing said tube from said material, and ejecting said slug from said tube, the improvement comprising:

providing said cutting tube in the form of a hollow tube having a lumen, extending between said distal and proximal ends, said lumen being of smaller diameter near said distal end than at said proximal end; and ejecting slugs of material from said proximal end, said lumen having a shoulder positioned a distance from said distal edge approximately equal to one or two times said thickness of said discard slug.

14. The improvement of claim 13, wherein said lumen includes:

a first portion, extending from said distal end to said shoulder, said first portion having a cross sectional configuration substantially congruent with a preselected cross sectional shape of a discard slug; and a second portion, extending from said shoulder to said proximal end, said second portion having a cross sectional configuration which permits free travel of said slug from said shoulder to said proximal end.

15. The improvement of claim 14, further including applying suction to said proximal end, whereby to extract slugs from said tube through said proximal end.

* * * * *